United States Patent [19]

Yabsley et al.

[11] Patent Number: 4,818,309

[45] Date of Patent: Apr. 4, 1989

[54] PRIMER COMPOSITION

[75] Inventors: Michael Yabsley, Cheltenham; Jill Hergt, Moonee Ponds, both of Australia

[73] Assignee: ICI Australia Limited, Victoria, Australia

[21] Appl. No.: 20,987

[22] Filed: Mar. 2, 1987

[30] Foreign Application Priority Data

Feb. 28, 1986 [AU] Australia ..... PH4836

[51] Int. Cl.[4] ..... C06B 45/00

[52] U.S. Cl. ..... 149/2; 149/21; 149/88; 149/92; 149/93

[58] Field of Search ..... 149/2, 21, 92, 93, 88

[56] References Cited

U.S. PATENT DOCUMENTS 4,357,184 11/1982 Binet et al. ..... 149/2

4,615,751 10/1986 Smith et al. ..... 149/2

*Primary Examiner*—Stephen J. Lechert, Jr.

*Attorney, Agent, or Firm*—Cushman, Darby & Cushman

[57] ABSTRACT

An explosive composition comprising (a) a water-in-oil emulsion comprising (i) a discontinuous aqueous phase comprising at least one oxygen-releasing salt, (ii) a continuous water-immiscible organic phase and (iii) an emulsifier, and (b) 20 to 75% w/w of the total composition of brisant explosive and wherein the emulsifier is chosen from poly[alk(en)yl] succinic acid and derivatives thereof.

13 Claims, No Drawings

PRIMER COMPOSITION

The present application relates to an explosive composition for use in blasting. In particular the present application relates to a primer composition comprising a water-in-oil emulsion composition.

Primer compositions currently in use are generally formed from cast self-explosives such as TNT. For example the well-known Pentolite primer is a mixture of pentaerythritoltetranitrate (PETN) and TNT. Although such primer compositions have proved successful, they have several inherent problems. The cast explosive is fairly brittle and tends to produce a powder easily, for example during transportation.

Cast primer compositions are generally very impact-sensitive and tend to degrade at elevated temperatures. This can cause difficulties in underground mining where primer compositions are required to be stable for long periods at temperatures of up to 80° C. or more.

Cast emulsion explosive compositions also have the disadvantage, that in the presence of water, any water-soluble components tend to be leached from the composition and the problem of instability at higher temperature is exacerbated.

In some applications it may be preferred to shape or mould primer compositions well after preparation. This cannot readily be done with prior art primer compositions.

We have now found that a versatile primer composition comprising a mixture of brisant explosive and a water-in-oil emulsion may be prepared by using selected emulsifiers chosen from poly[alk(en)yl] succinic acid and derivatives thereof.

Accordingly we provide an explosive composition comprising (a) a water-in-oil emulsion comprising at (i) a discontinuous aqueous phase comprsising at least one oxygen-releasing salt, (ii) a continuous water-immiscible organic phase and (iii) an emulsifier, and (b) 20 to 75% w/w of the total composition of brisant explosive and wherein the emulsifier is chosen from poly[alk(en)yl] succinic acid and derivatives thereof. Typical examples of derivatives of said poly[alk(en)yl] succinic acid may include esters, anydrides, imides and amides thereof. Preferably, said emulsifier has an average molecular weight in the range 400 to 5000.

In said poly[alk(en)yl] succinic acid-based emulsifier it is preferred that the hydrocarbon chain is derived from polymerization of a mono-olefin and generally the polymer chain will contain from 40 to 500 carbon atoms.

Preferably the poly[alk(en)yl] moiety is derived from olefins containing from 2 to 6 carbon atoms and in particular from ethylene, propylene, 1-butene and isobutene. The emulsifier may be derived from poly[alk(en)yl] succinic anhydride.

Examples of poly[alk(en)yl] succinic acid derivatives are disclosed in Australian Patent Application No. 40006/85. Such derivatives are commercially-available materials which are made by an addition reaction between a polyolefin containing a terminal unsaturated group and maleic anhydride, optionally in the presence of a halogen containing catalyst. The succinic anhydride residue in the above compounds may be reacted to introduce a polar group. Generally the said polar group is monomeric although oligomeric groupings containing not more than about 10 repeat units may be employed. Examples of suitable polar groups may include polar groups derived from polyols such as glycerol, pentaerythritol, and sorbitol or an internal anhydride thereof (e.g. sorbitan); from amines such as ethylene diamine, tetraethylene triamine and dimethylaminopropylamine; from amides such as 2-hydroxypropanolamide; from alkanolamines such as ethanolamine or diethanolamine; and from heterocyclics such as oxazoline or imidazoline. Suitable oligomeric groupings include short-chain poly(oxyethylene) groups (i.e. those containing up to 10 ethylene oxide units).

Formation of emulsifiers for use in accordance with the invention may be effected by conventional procedures depending upon their chemical nature.

In order to prepare a derivative of poly(alk(en)yl)succinic acid comprising a polar group derived from an alcohol or amine, the acid group or anhydride thereof can be caused to react with the hydroxyl or amino group by heating the two components together in a suitable solvent, in the presence of a catalyst if desired.

The emulsifiers may be of a non-ionic character, but they may alternatively be anionic or cationic in nature, as, for example, where the hydrophilic moiety incorporates the residue of a polyamine or a heterocyclic compound.

Preferred emulsifiers are poly(isobutylene) succinic anhydride derivatives and most preferably condensates thereof with ethanolamine.

The compositions of the invention may comprise a single emulsifier although a mixture of two or more emulsifiers may be employed, if desired.

We have discovered that the combination of a water-in-oil emulsion explosive prepared using the above-mentioned emulsifiers and the brisant explosive offers notable advantages over known primer compositions. The primer compositions of our invention generally have a putty-like consistency and remain mouldable for months after storage at room temperature. Consequently, even after months of storage it is generally possible to mould the composition to the desired shape, allowing the composition to be cartridged or shaped by hand without heating.

Furthermore, even at higher temperatures of for example 40°-100°, which would be encountered in some applications, we have found that the compositions maintain their putty-like consistency for many days.

The compositions of the present invention also maintain their sensitivity to detonation for months after preparation.

Unlike conventional cast primers such as pentolite, the compositions of this invention are very insensitive to impact and in many instances compositions can withstand the impact of a 14 kg weight dropped from 1.5 meters. Furthermore, the compositions remain relatively insensitive to impact at temperatures of up to at least 80° C.

Consequently, not only do the primer composition have the advantage of producing high power explosions when initiated by the commonly used shock initiating techniques, but they are also extremely safe.

To provide the best handing characteristics, it is preferred that the brisant explosive be a solid at ambient temperature. For example, such brisant explosives may include pentaerythritoltetranitrate (PETN) cyclotrimethylene trinitramine (RDX), trinitrophenylmethylnitramine (TETRYL) and cyclotetramethylene tetranitramine (HMX).

The amount of brisant explosive is preferably in the range 30 to 60% w/w of the total composition and we have found PETN compositions in this range to be particularly successful.

The amount of said emulsifier required in the composition of the invention is generally 0.1 to 5.0% although greater amounts may be used if desired.

Other emulsifiers such as those, conventionally used in preparation of water-in-oil emulsion explosives may be incorporated into the primer composition in addition to the hereinabove defined select emulsifiers.

Examples of conventional emulsifiers include sorbitan esters, such as sorbitan sesqui-oleate, sorbitan monooleate, sorbitan mono-palmitate, sorbitan mono-stearate and sorbitan tristearate, the mono- and diglycerides of fat-forming fatty acids, soyabean lecithin and derivatives of lanolin, such as isopropyl esters of lanolin fatty acids, mixtures of higher molecular weight fatty alcohols and wax esters, ethoxylated fatty ethers, such as polyoxyethylene (4) lauryl ether, polyoxyethylene (2) oleyl ether, polyoxyethylene (2) stearyl ether, polyoxyalkylene oleyl laurate, and substituted oxazolines, such as 2-oleyl-4,4'-bis(hydroxymethyl)-2-oxazoline. Suitable mixtures of such conventional emulsifiers may also be selected for use, together with one or more modifiers, in the compositions of the present invention.

Generally the combined amount of emulsifiers will not exceed about 5% of the total composition although higher proportions may be used if desired.

The oxygen releasing salt may be chosen from said salts capable of releasing oxygen in an explosive environment in an amount and at a rate sufficient to confer acceptable explosive characteristics on the primer composition. Inorganic oxidizer salts conventionally employed in the production of emulsion explosive compositions, and suitable for inclusion in the compositions of the present invention include ammonium salts and salts of the alkali- and alkaline-earth metals, such as the nitrate, chlorate and perchlorate salts, and mixtures thereof. Other suitable salts include hydrazine nitrate and urea perchlorate. The oxygen-supplying component may also comprise an acid, such as nitric acid.

Typically the discontinuous phase used in the present composition will comprise 20 to 97% w/w of the emulsion component and hence is generally in the range of 5 to 78% w/w of total primer composition.

Usually the discontinuous phase will be used in an amount of 70 to 97% of the emulsion component (approx 18 to 78% w/w of total primer composition).

It is preferred that the primer composition comprises 1 to 20% w/w water. We have generally found that a primer of ideal consistency comprises water in the range of 5 to 15% w/w of the total composition.

The organic medium capable of forming the continuous phase of an emulsion explosive composition in accordance with the invention serves as a fuel for the explosive composition and should be substantially insoluble in the component(s) of the discontinuous phase with which it should be capable of forming an emulsion in the presence of an effective amount of an appropriate emulsifying agent. Ease of emulsification depends, inter alia, on the viscosity of the organic medium, and although the resultant emulsion may have a substantially solid continuous phase, the organic medium will preferably capable of existing intially in a sufficiently fluid state, if necessary in response to appropriate temperature adjustment, to permit emulsification to proceed.

Suitable organic media which are capable of existing in the liquid state at convenient emulsion formulation temperatures include saturated and unsaturated aliphatic and aromatic hydrocarbons, and mixtures thereof. Preferred media include refined (white) mineral oil, diesel oil, paraffin oil, petroleum distillates, benzene, toluene, dinitrotoluene, styrene, xylenes, and mixtures thereof.

In addition to the organic fuel medium the continuous phase may optionally comprise a wax to control the rheology of the system, although the presence of a wax is not essential. Suitable waxes include petroleum, mineral, animal, and insect waxes. The preferred waxes have melting temperatures of at least 30° C. and are readily compatible with the formed emulsion. A preferred wax has a melting temperature in a range of from about 40° C. to 75° C.

Typically the organic or continuous phase of the emulsion comprises from 2 to 15% (preferably 3 to 10%) by weight of the emulsion component.

Hence typically the continuous phase comprises 0.5 to 12% (preferably 0.75 to 8%) by weight of the total composition.

If desired, additional components may be incorporated into the compositions of the present invention. For example, supplementary fuel components may be included. Typical supplementary fuel components suitable for incorporation into the discontinuous phase include soluble carbohydrate materials, such as glucose, sucrose, fructose, maltose and molasses, lower glycols, formamide and urea.

Supplementary fuel components which may be incorporated into the continuous phase include fatty acids, higher alcohols, vegetable oils, aliphatic and aromatic nitro organic compounds, such as dinitrotoluene, nitrate esters, and solid particulate materials such as coal, graphite, carbon, sulphur, aluminium and magnesium.

The composition of the invention may also comprise a buffer to maintain the pH with a certain range. For example where the emulsifier comprises a free acid group or groups or a group capable of hydrolyzing, to a carboxylic acid (such as an anhydride) it may be preferred to buffer the composition to give a pH over 4.5.

Combinations of the hereinbefore described supplementary fuel components may be employed, if desired.

Where used supplementary fuels may typically be present in the range 0–20% of the total composition.

Thickening and or cross-linking agents may be included in the compositions, if desired, generally in small amounts up to the order of 10%, and preferably from 1 to 5%, by weight of the total explosive composition. Typical thickening agents include natural gums, such as guar gum or derivatives thereof, and synthetic polymers particularly those derived from acrylamide.

Minor amounts of non-volatile, water insoluble polymeric or elastomeric materials, such as natural rubber, synthetic rubber and polyisobutylene may be incorporated into the continuous phase. Suitable polymeric additives include butadiene-styrene, isopreneisobutylene, or isobutylene-ethylene copolymers. Terpolymers thereof may also be employed to modify the continuous phase, and in particular to improve the retention of occluded gases in the compositions.

The primer compositions of the present invention may optionally comprise a discontinuous gaseous component to reduce their density (to less than 1.5), and enhance their sensitivity. If desired, the gaseous component, for example nitrogen, may be incorporated into the compositions of the present invention as fine gas bubbles dispersed throughout the composition, hollow particles which are often referred to as microballoons or microspheres, porous particles, or mixtures thereof are a preferred source of occluded gas A discontinuous phase of fine gas bubbles may be incorporated into the compositions of the present invention by mechanical agitation, injection or bubbling the gas through the composition, or by chemical generation of the gas in situ. Suitable chemicals for the in situ generation of gas bubbles include peroxides, such as hydrogen, peroxide, nitrites, such as sodium nitrite, nitrosoamines, such as N,N'-dinitrosopentamethylenetetramine, alkali metal borohydrides, such as sodium borohydride, and carbonates, such as sodium carbonate. Suitable hollow particles include small hollow microspheres of glass and resinous materials, such as phenol-formaldehyde and ureaformaldehyde. Suitable porous materials include expanded minerals, such as perlite.

The primer compositions according to the present invention may be prepared by mixing the water-in-oil emulsion, prepared by conventional emulsification techniques, with the appropriate amount of brisant explosive.

If desired, the gas component may for example be added during cooling such tht the prepared emulsion comprises from about 0.05 to 50% by volume of gas at ambient temperature and pressure. However if occluded gas is used it is preferred that it be added as microballoons during addition of the brisant.

Thus in order to prepare the emulsion the oxygen-releasing salt(s) may be dissolved in the aqueous phase at a temperature above the fudge point of the salt solution, preferably at a temperature in the range of from 25° to 110° C., and a mixture.

The aqueous phase is then combined with the organic phase and the emulsifier with rapid mixing to produce the emulsion component. Mixing is generally continued until the emulsion is uniform. brisant explosive, preferably in the form of a fine powder is then mixed with the emulsion to give an even consistency.

The primer composition may optionally be packaged into appropriately sized charges. The consistency of the composition allows packaing or moulding of appropriate charges to be carried out months after preparation.

The invention is illustrated by reference to the following examples

EXAMPLE 1

A mixture of chemically pure ammonium nitrate (78.6 parts) and water (16.1 parts) was heated at 98° C. until the oxidiser was dissolved.

The hot aqueous solution was then poured, with rapid stirring into a solution of emulsifier* (1 part) in parraffin oil (4.3 parts). After cooling pentaerythritol tetranitrate (PETN) (66.6 parts) was mixed into the composition to produce an even consistency.

*The emulsifier used was a 1:1 (molar) condensate of polyisobutenyl succinic anhydride (number average molecular weight of approx 1200 with molecular weight distribution of up to 3000) and ethanolamine prepared by heating the two ingredients with stirring at 70° C.

EXAMPLE 2

The procedure of Example 1 was repeated using as the emulsifier a derivative of "LUBRIZOL" 5986 ("LUBRIZOL" is a trade mark; "LUBRIZOL" 5986 is a commercially available poly(isobutylene) succinic anhydride prepared by forming 1:1 (molar) condensate with ethanolamine.

EXAMPLE 3

The impact sensitivity of the composition of Example 1 was examined at a range of temperatures using a drop weight test.

The test was carried out at 16° C., 36° C., 56° C., 68° C. and 78° C. In all cases the composition showed no ignition from the impact of a 14 kg weight dropped from a height of 150 cm.

COMPARATIVE EXAMPLE 1

The impact sensitivity of a commonly used commercially available PENTOLITE primer was examined using the drop weight test as in Example 3. The results are shown in Table 1.

TABLE I

| | | 16° C. | 36° C. | 56° C. | 68° C. | 78° C. |
|---|---|---|---|---|---|---|
| IGNITION OCCURRED USING | Hammer Wt | 6.5 | 6.5 | 6.5 | 6.5 | 6.5 |
| | Drop Height | 20 | 20 | 10 | 15 | 30 |
| NO IGNITION OCCURRED USING | Hammer Wt | 6.5 | 6.5 | 6.5 | 8.0 | 6.5 |
| | Drop Height | 10 | 15 | 5 | 10 | 20 |

In all cases the Pentolite type primer fired at or below 20 cm when lit with either a 6.5 kg or 8 kg hammer.

EXAMPLE 4

The power of the primer composition of Example 1 was studied using different methods of initiator which are well known in the art. Primer samples were all of equivalent length (51 mm) and diameter (45 mm) and the depth of impression made in 5 cm thick aluminium plate was measured.

Each shot was fired electrically using the detonator size specified below or, where cord sensitivity was being studied, a #6 detonator was taped onto 30 cm length of cord and the cord was inserted into the bottom of the primer. Each test was performed three times.

TABLE 2

(Average Dent Depth (mm))
"Fail" indicates no initiation
"Pass Rate" indicates the ratio of initiation to the number of test.

| Initiator | 16° C. | 36° C. | 56° C. | 68° C. | 78° C. |
|---|---|---|---|---|---|
| #6 Det | 11.670 | 12.170 | 11.905 | 11.327 | 10.554 |
| | 11.224 | 12.719 | 11.734 | 10.620 | 11.452 |
| | 11.424 | splintered | 11.750 | 12.275 | 11.551 |
| Pass Rate | 3/3 | 3/3 | 3/3 | 3/3 | 3/3 |
| #2 Det | 10.295 | 10.474 | 10.721 | 10.398 | 10.902 |
| | 10.003 | 10.722 | 10.167 | 10.607 | 10.881 |
| | 11.091 | 9.684 | 9.706 | 10.163 | 11.102 |
| Pass Rate | 3/3 | 3/3 | 3/3 | 3/3 | 3/3 |
| Trunkcord | 11.618 | 12.365 | 11.904 | 12.651 | 11.717 |
| | 10.672 | 11.527 | 10.172 | 12.192 | 11.810 |
| | 9.419 | 10.862 | 12.057 | 12.484 | 11.729 |
| Pass Rate | 3/3 | 3/3 | 3/3 | 4/4 | 3/3 |
| SK 300 | Fail | 9.394 | 1.776 | 9.134 | 4.160 |
| | Fail | no dent | <<1 mm | 1.679 | 5.419 |
| | Fail | no dent | 0.799 | 2.531 | 10.222 |
| Pass Rate | 0/4 | 3/3 | 3/3 | 4/4 | 3/ |

COMPARATIVE EXAMPLE 2

The tests of example 3 were repeated using a PENOLITE primer of the same dimensions.

The results are shown in Table 3.

TABLE 3

| Initiator | Average Dent Depth (mm) 16° C. | 36° C. | 56° C. | 68° C. | 78° C. |
|---|---|---|---|---|---|
| #6 Det | *splintered | 9.371 | 10.022 | 4.070 | Fail |
| | 9.221 | 9.288 | 3.309 | 9.539 | Fail |
| | 10.790 | 9.079 | 7.074 | 9.438 | Fail |
| Pass Rate | 3/3 | 3/3 | 3/3 | 3/3 | 0/3 |
| #6 Det | Fail | Fail | Fail | Fail | — |
| | *Pass-no plate | Fail | Fail | Fail | — |
| | Fail | Fail | Fail | Fail | — |
| Pass Rate | ⅓ | 0/3 | ¼ | 0/3 | — |
| Trunkcord | 9.228 | 8.052 | Fail | Fail | 2.810 |
| | 7.255 | 7.465 | Fail | Fail | Fail |
| | 8.043 | 6.650 | Fail | Fail | Fail |
| Pass Rate | 3/3 | 3/3 | 0/3 | 0/3 | ¼ |
| SK 300 | Fail | Fail | — | — | — |
| | Fail | *Pass | — | — | — |
| | Fail | Fail | — | — | — |
| Pass Rate | 0/3 | ⅓ | — | — | — |

*No measurement made

EXAMPLE 5

Primer composition prepared according to Example 1 was stored at room temperature for a period of 2 years. The power on detonation of the 2 year old composition was compared with power of a freshly prepared sample using the procedure of Example 4.

Test were performed 3 times and results are shown in Table 4.

TABLE 4

| Initiator | 2 Year Old Primer | (Average Dent Depth mm) Freshly Prepared |
|---|---|---|
| #6 Det | 11.796 | 11.670 |
| | 11.329 | 11.224 |
| | 10.757 | 11.424 |
| #2 Det | 10.554 | 10.295 |
| | 8.823 | 10.003 |
| | 10.234 | 11.091 |

The results show that there was no significant decrease in sensitivity and power after 2 years of storage.

Even after 2 years storage the material retained its putty like consistency, the only visable change being the formation of a slight crust on the surface of the composition.

We claim:

1. A primer explosive composition comprising (a) a water-in-oil emulsion comprising (i) a discontinuous aqueous phase comprising at least one oxygen-releasing salt, (ii) a continuous water-immiscible organic phase and (iii) an emulsifier, and (b) 20 to 75% w/w of the total composition of brisant explosive and wherein the emulsifier includes a polar group and is a reaction product of a poly(alk(en)yl) succinic acid and a compound selected from the group consisting of glycerol, pentaerythritol, sorbitol, or an internal anhydride thereof, ethylene diamine, tetraethylene triamine, dimethylaminopropylamine; 2-hydroxypropanolamide, ethanolamine, diethanolamine, oxazoline, and imidazoline, and short-chain poly(oxyethylene) groups containing up to 10 ethylene oxide units, said composition having a putty-like consistency and remaining mouldable and sensitive to detonation even after storage.

2. A composition according to claim 1 wherein the derivative is a condensate of poly(isobutylene) succinic acid and ethanolamine.

3. A composition according claim 1 wherein the emulsifier has an average molecular weight in the range 400 to 5000.

4. A composition accordingly to claim 1 wherein the brisant explosive is selected from the group consisting of pentaerythritoltetranitrate, cyclotrimethylenetrinitraminc, trinitrophenylmethylnitramine and cyclotetramethylene tetranitrate.

5. A composition according to claim 4 wherein the brisant explosive is pentaerythritoltetranitrate.

6. A composition according to claim 1 wherein the brisant explosive comprises 30 to 60% w/w of the total explosive.

7. A composition according to claim 1 wherein the emulsifier comprises 0.1 to 5.0 w/w of the total explosive.

8. A composition according to claim 1 wherein the oxygen-releasing salt is selected from the group consisting of the alkali metal, alkaline earth metal and ammonium, nitrates, chlorates and perchlorates, and mixtures thereof.

9. A composition according to claim 8 wherein the oxygen-releasing salt is selected from the group consisting of ammonium nitrate, sodium nitrate, calcium nitrate and mixtures thereof.

10. A composition according to claim 1 wherein the oxygen-releasing salt component comprises 18 to 78% w/w of the total explosive composition.

11. A composition according to claim 1 wherein the water-immiscible organic phase comprises one or more fuels selected from the groups consisting of mineral oil, diesel oil, paraffin oil, petroleum distillates, benzene, toluene dinitrotoluene, styrene, xylenes and mixtures thereof.

12. A composition according to claims 1 wherein water comprises 1 to 20% w/w of the total composition.

13. A composition according to claim 12 wherein water comprises 5 to 15% w/w of the total composition.

* * * * *